US007971583B2

(12) United States Patent
Chu

(10) Patent No.: US 7,971,583 B2
(45) Date of Patent: Jul. 5, 2011

(54) FIRE CONTROL DEVICE AND METHOD FOR A TOY GUN

(75) Inventor: Chen-Tang Chu, Taichung County (TW)

(73) Assignee: I Chih Shivan Enterprise Co., Ltd., Taichung County (TW)

( * ) Notice: Subject to any disclaimer, the term of this patent is extended or adjusted under 35 U.S.C. 154(b) by 459 days.

(21) Appl. No.: 12/267,037

(22) Filed: Nov. 7, 2008

(65) Prior Publication Data

US 2010/0115816 A1 May 13, 2010

(51) Int. Cl.
*F41B 11/00* (2006.01)

(52) U.S. Cl. ..... 124/32; 124/66

(58) Field of Classification Search ..... 124/32, 124/37, 38, 39, 65, 66, 67
See application file for complete search history.

(56) References Cited

U.S. PATENT DOCUMENTS

| | | | | |
|---|---|---|---|---|
| 4,899,717 | A * | 2/1990 | Rutten et al. | 124/67 |
| 5,727,538 | A * | 3/1998 | Ellis | 124/77 |
| 6,564,788 | B1 * | 5/2003 | Hu | 124/66 |
| 6,772,746 | B2 * | 8/2004 | Gabrel | 124/32 |
| 7,900,622 | B2 * | 3/2011 | Douglas et al. | 124/73 |
| 2004/0216727 | A1 * | 11/2004 | Rice et al. | 124/73 |
| 2008/0078369 | A1 * | 4/2008 | Yeung | 124/67 |

* cited by examiner

*Primary Examiner* — John Ricci
(74) *Attorney, Agent, or Firm* — Muncy, Geissler, Olds & Lowe, PLLC

(57) ABSTRACT

A fire control device for a toy gun and a method therefor are provided. The device includes a trigger switching module, a firing mode selecting module, a control module, a power module and a motor module. Through a selection via the firing mode selecting module, the control module can control the time that the power module supplies the motor module, so that the lasting time period that the motor module drives a firing module to fire can be controlled, thereby multiple firing modes, single fire, 3-round burst, continuous fire and weapon safety, can be achieved.

18 Claims, 6 Drawing Sheets

FIRE CONTROL DEVICE AND METHOD FOR A TOY GUN

FIELD OF THE INVENTION

The present invention is related to a fire control device and method of toy gun, and more particularly, to a fire control device and method employing a circuit to control multiple firing modes.

BACKGROUND OF THE INVENTION

The current for manufacturing toy gun is to imitate the real gun as far as possible because only as the function, the shape and the weight of the toy gun can approach the real gun closer, the player can experience the reality more. Therefore, the multiple firing modes of rifle and submachine gun, such as, single fire, 3-round burst, continuous fire and weapon safety, are also put into practice in toy guns. Currently, the real gun utilizes mechanical design to control the reciprocating movement of the trigger to be once, thrice, cyclic and hold so as to achieve different firing modes of single fire, 3-round burst, continuous fire and weapon safety.

However, this kind of mechanical design actually is difficult to be applied to toy gun, especially electric toy gun.

SUMMARY OF THE INVENTION

Consequently, for solving the problem described above, the present invention provides a device and method for controlling the burst shot of toy gun.

The object of the present invention is to provide a fire control device and method of the toy gun by utilizing circuit, so that through controlling the time of power supply to be different, different firing modes can be achieved.

A fire control device of a toy gun for percussing a firing module includes a trigger switching module, a firing mode selecting module, a control module, a power module and a motor module. The trigger switching module has a trigger, the control module is connected with the trigger switching module and the firing mode selecting module, the power module is connected to the control module and supplies power thereto, and the motor module is connected with the control module.

The method includes steps of: selecting a firing mode and providing a corresponding firing mode signal by the firing mode selecting module; providing a percussion signal by pressing the trigger; producing an enable signal by the control module after receiving the percussion signal and altering a holding time of the enable signal by the control module according to the received firing mode signal; providing a motor driving power by the power module as the enable signal occurs; and producing a turning power by the motor module as being driven by the motor driving power, so as to drive a transmission gear set to rotate, thereby compressing a piston to percuss the firing module.

Accordingly, through changing the holding time of the enable signal, the time that the power module provides the motor driving power to the motor module to produce the turning power can be changed, and thus, the lasting time that the turning power drives the transmission gear set to rotate and thus compress the position to percuss the firing module is also altered, thereby through controlling the period of holding time of the enable signal, the selection for the firing modes, single fire, 3-round burst, continuous fire and weapon safety, can be achieved.

BRIEF DESCRIPTION OF THE DRAWINGS

The foregoing aspects and many of the attendant advantages of this invention will be more readily appreciated as the same becomes better understood by reference to the following detailed description, when taken in conjunction with the accompanying drawings, wherein.

DESCRIPTION OF THE PREFERRED EMBODIMENT

Figure 1:
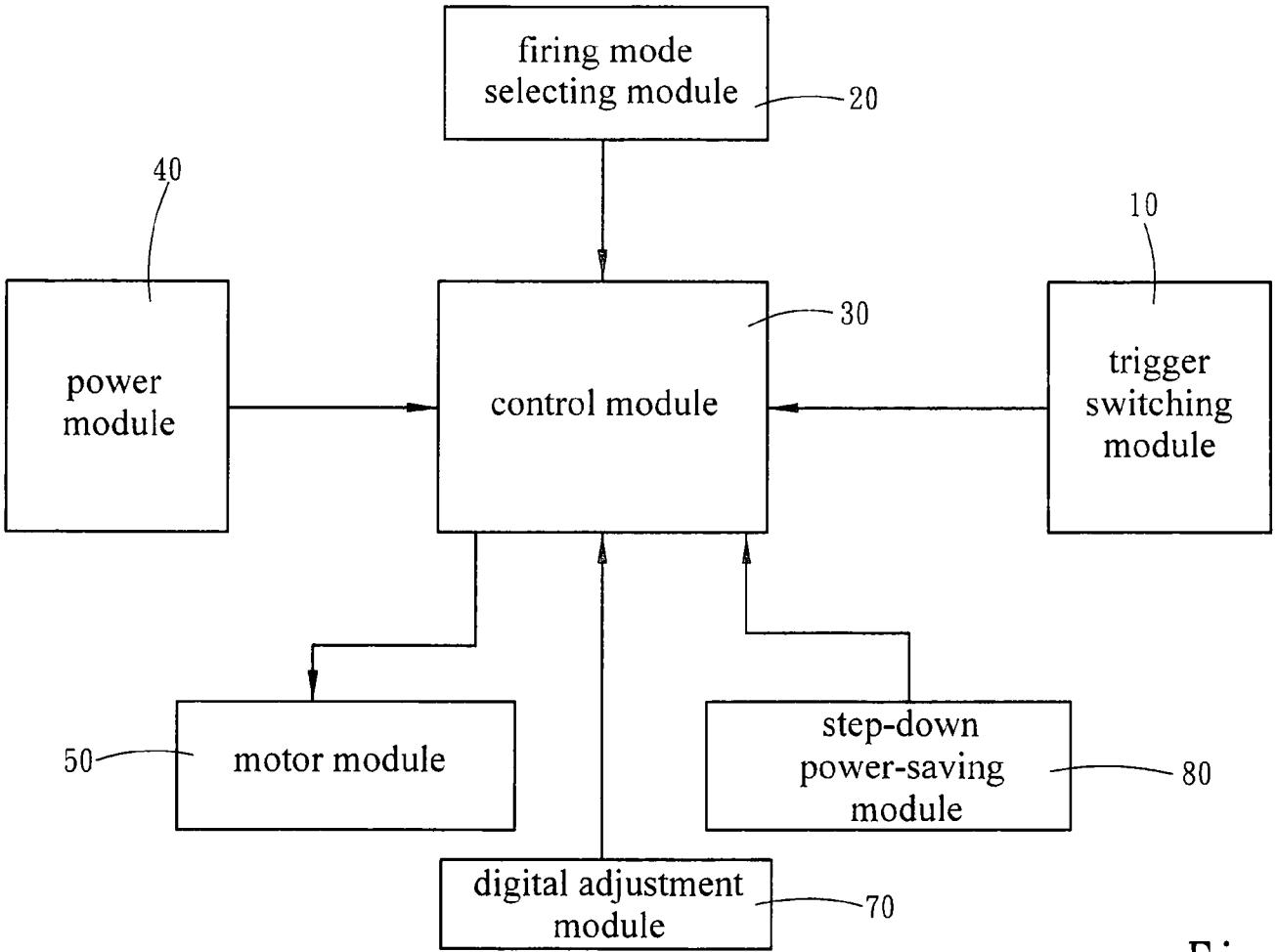
FIG. 1 is a connection block diagram showing the system of the present invention.
Figure 2:
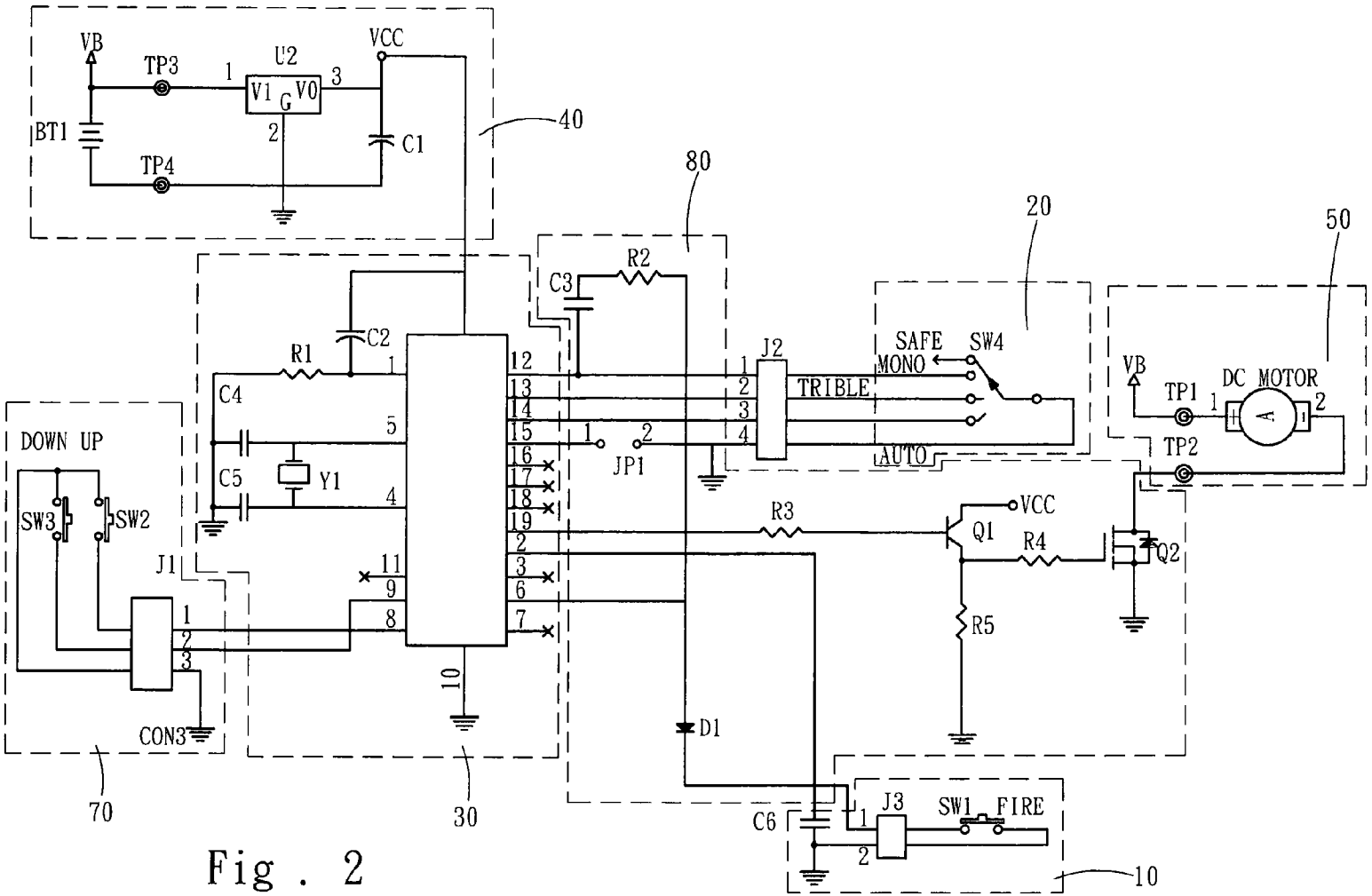
FIG. 2 is a circuit block diagram showing the system of the present invention.
Figure 3:
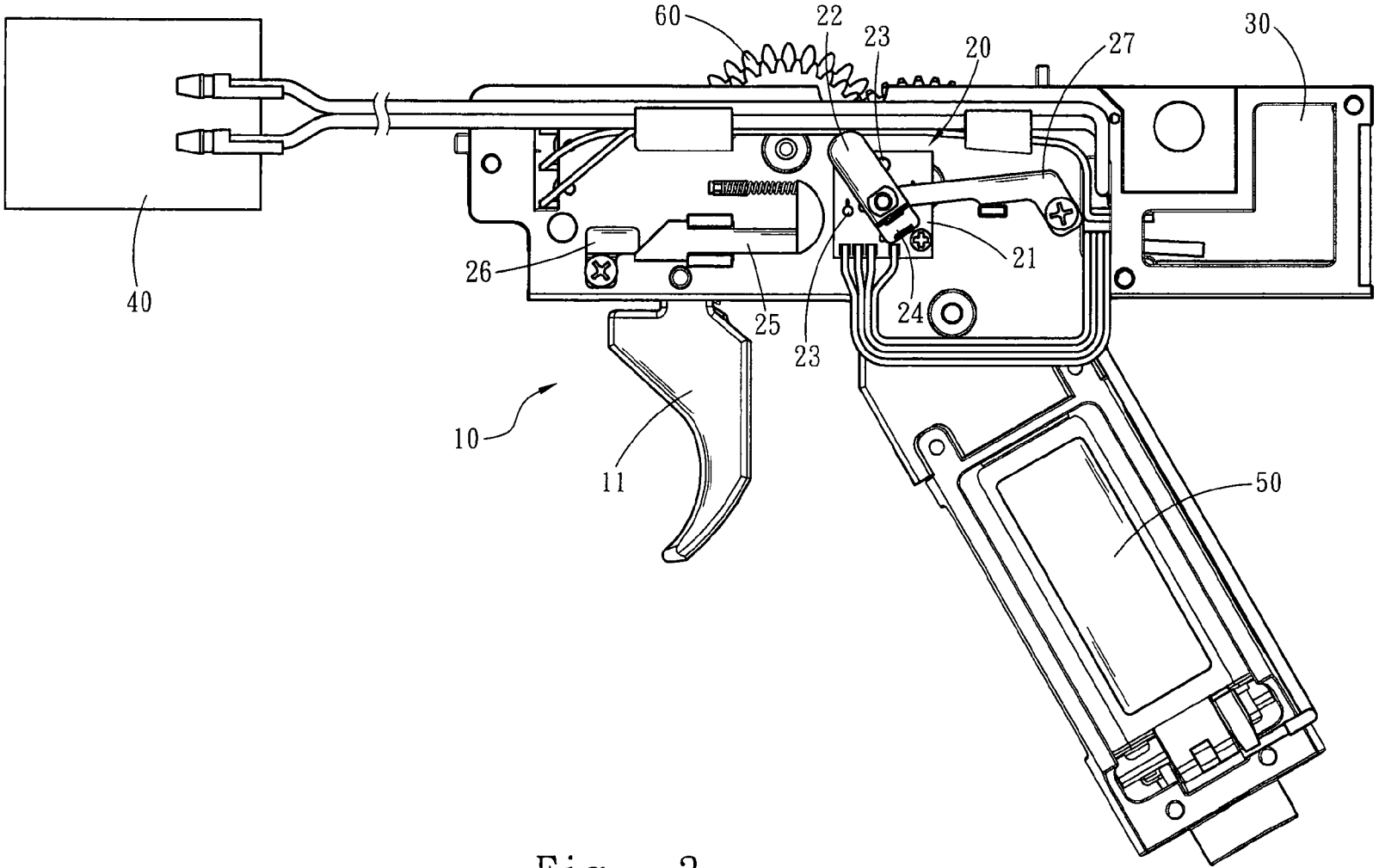
FIG. 3 is a drawing showing the mechanical structure of the present invention.

Please refer to FIG. 1, FIG. 2 and FIG. 3. A fire control device in a toy gun for percussing a firing module (not shown) includes a trigger switching module 10, a firing mode selecting module 20, a control module 30, a power module 40 and a motor module 50. The trigger switch module 10 has a trigger 11 which is provided to be pressed to produce a percussion signal, the firing mode selecting module 20 is provided to select the firing mode for producing a firing mode signal corresponding to the selected firing mode, the control module 30 is connected with the trigger switching module 10 and the firing mode selecting module 20 for receiving the percussion signal and the firing mode signal, so as to produce an enable signal according to the percussion signal and alter the holding time of the enable signal according to the firing mode signal.

The power module 40 which is connected to the control module 30 is provided to supply power to the control module 30 and also to supply a motor driving power as the enable signal is produced. The motor module 50 which is connected with the control module 30 will be driven by the motor driving power to produce a turning power so as to drive a transmission gear set 60 to rotate, thereby compressing a piston (not shown) to percuss the firing module.

Moreover, the present invention also includes a digital adjustment module 70 for fine tuning the holding time of the enable signal. And, the present invention further can include a step-down power-saving module 80, which is connected with the control module 30, for driving thereof into a power-saving mode as the control module 30 has not received the percussion signal and the firing mode signal after a particular period of time, and the control module 30 will maintain the power saving mode until being waked up by the execution of pressing the trigger 11 and/or the selecting execution of the firing mode selecting module 20.

Figure 4:
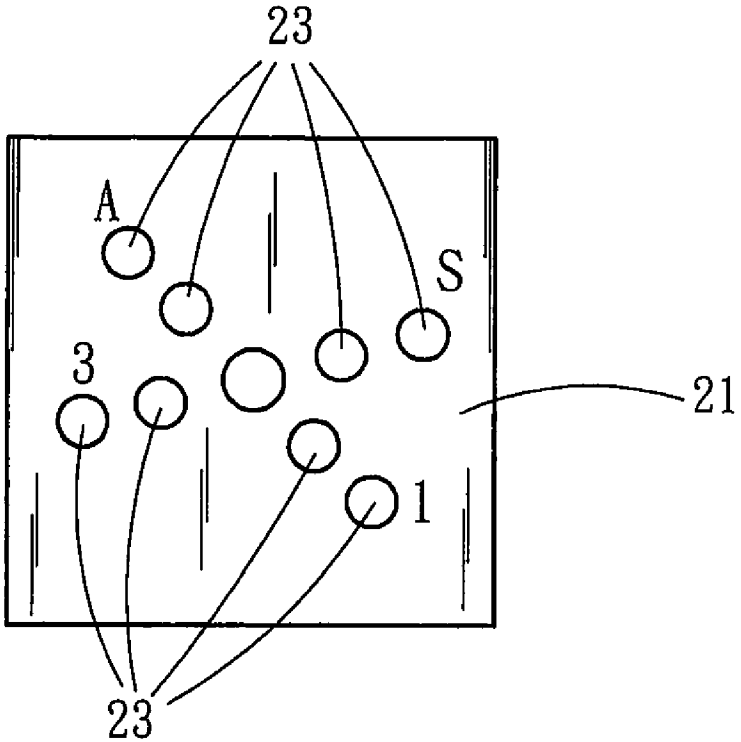
FIG. 4 is a drawing showing the base structure of the present invention.

Please further refer to FIG. 4. The firing mode selecting module 20 can include a base 21 and a selecting shaft 22 pivoted on the base 21. The base 21 has at least two contact points 23, and the selecting shaft 22 has a conductive portion 24 for contacting with the base 21, wherein when the selecting shaft 22 is moved to rotate on the base 21, the conductive portion 24 will in turn pass the at least two contact points 23 of the base 21. In the example shown in FIG. 4, the base 21 has four contact points 23 mounted thereon which are respectively corresponding to "single fire", "3-round burst", "continuous fire" and "weapon safety", so that through the conductive portion 24 respectively stays at and conducts with different contact points 23, the selection of firing mode can be achieved.

Figure 5:
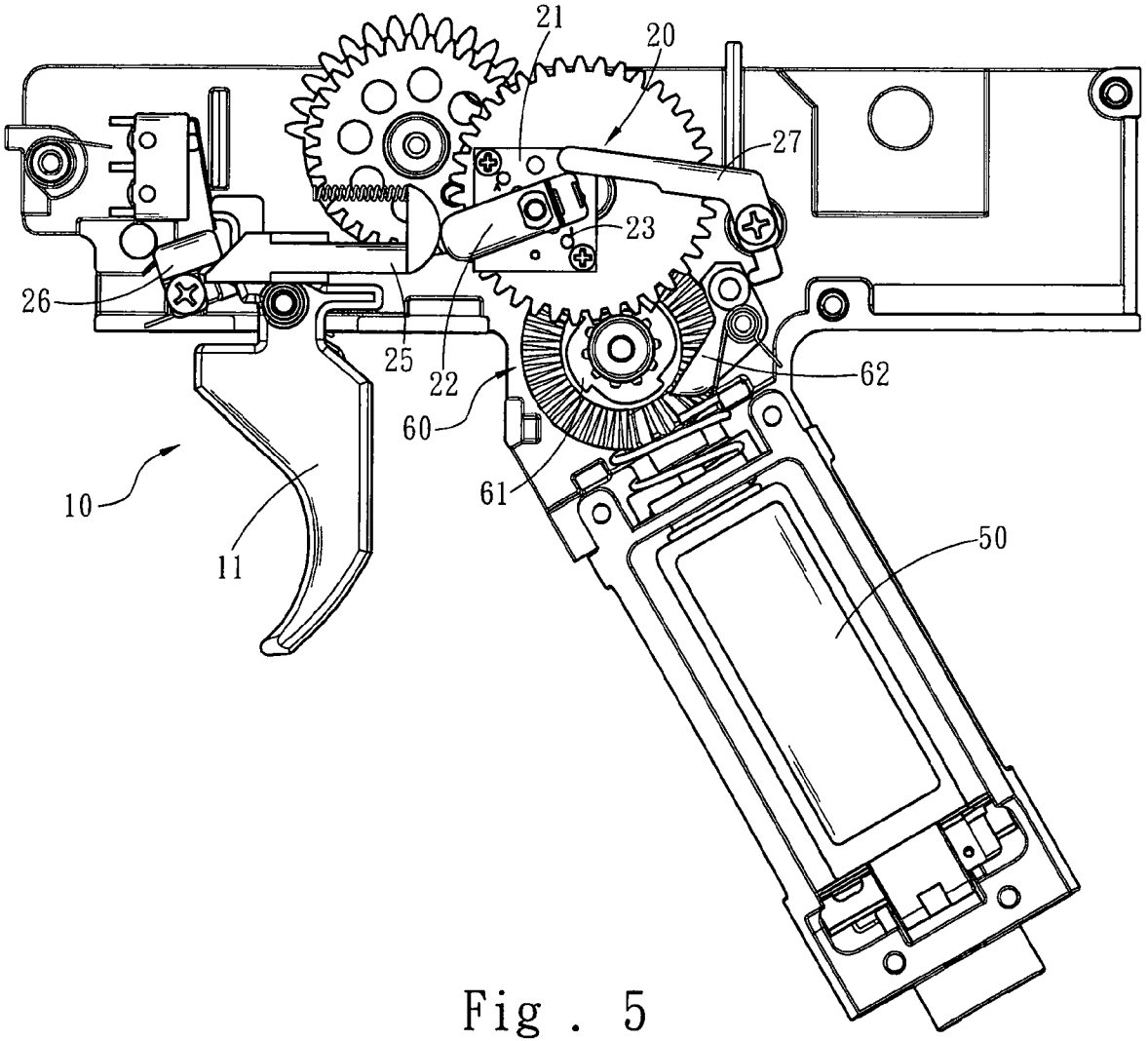
FIG. 5 is a drawing showing the mechanical motion A of the present invention.

Please further refer to FIG. 5, in which the selecting shaft 22 stays at one of the at least two contact points 23 which corresponds to the "weapon safety" mode. At this time, the selecting shaft 22 pushes a linking rod 25, which is capable of automatic reciprocation, then the linking rod 25 moves to turn an engaging knob 26, and then the engaging knob 26 locks the trigger 11, so as to ensure that the trigger 11 will not be moved as error pressing occurs. Besides, the transmission gear set 60 has an anti-reverse structure 61 for engaging with an anti-reverse claw 62, which is capable of automatic reciprocation, so as to block the reversion of the transmission gear set 60. Then, the selecting shaft 22 pushes a turning shaft 27 to turn, so as to push the anti-reverse claw 62 to disengage with the anti-reverse structure 61, and thus, the transmission gear set 60 executes a reverse turn for pushing the piston and releasing the energy stored in the piston, thereby ensuring security and also elongating the life time of the spring used in the piston since a long-time compression of the spring might cause elasticity fatigue.

Figure 6:
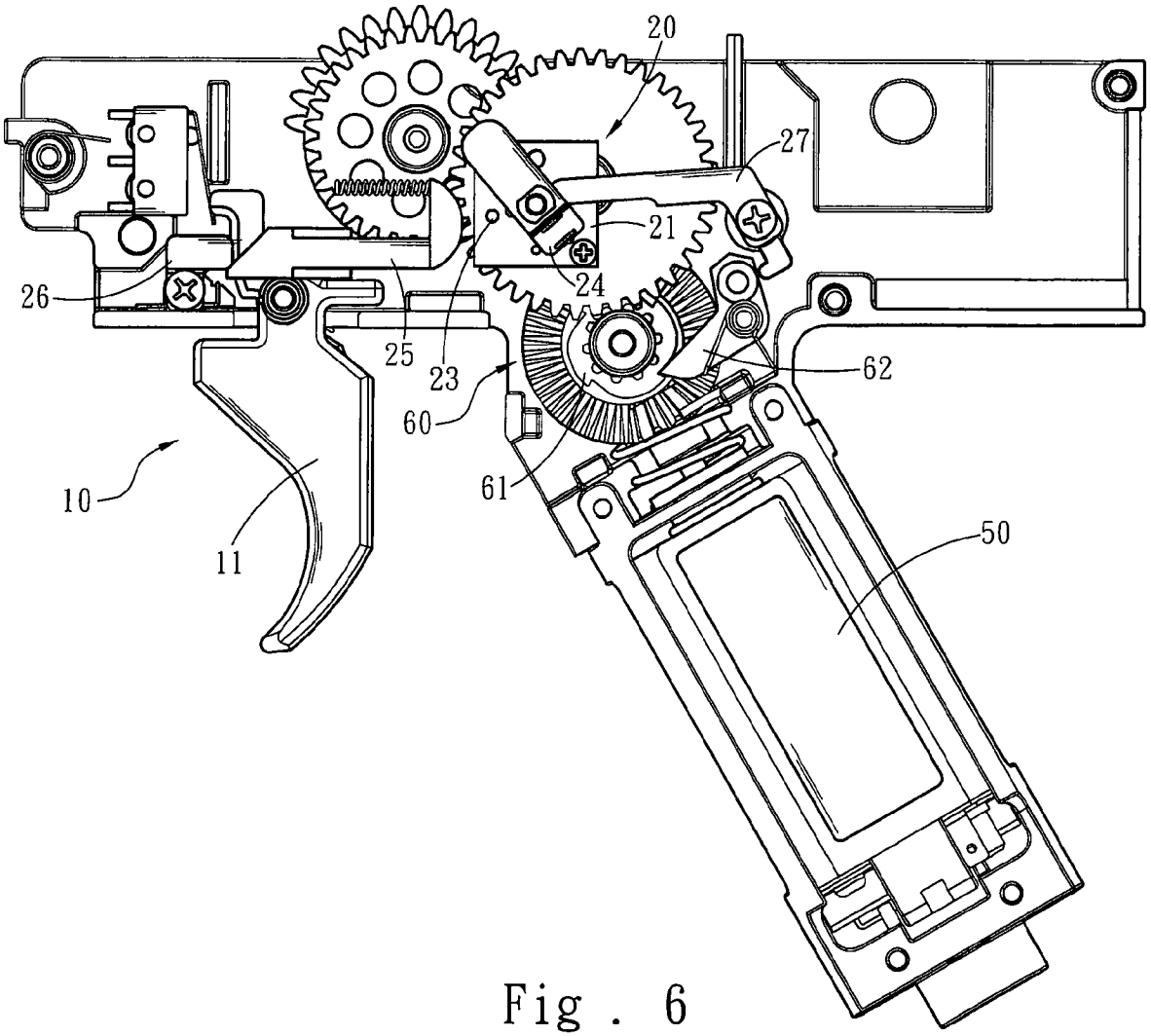
FIG. 6 is a drawing showing the mechanical motion B of the present invention.

Please refer to FIG. 6. According to the present invention, the selecting shaft 22 can be turned for locating the conductive portion 24 at different contact points 23, so as to select different firing modes by altering the holding time of the enable signal. For example, if the time for the firing module to execute a shot at the first time is A and the time to perform a sequential shot is B, then for executing the single fire, it only needs to restrict the holding time of the enable signal in a range between A and A+B. Similarly, if the holding time is restricted in a range between A+2B and A+3B, then the 3-round burst will be executed. In addition, if the holding time of the enable signal is controlled to be equal to the time for pressing the trigger 11, then the continuous fire will be performed.

In the aforesaid, according to the present invention, only through providing power to the firing module, the toy gun can fire constantly, and through executing a selection via the firing mode selecting module 20, the holding time of the enable signal can be altered so as to change the power supplying time for the motor, so that the selection of the firing mode can be achieved by controlling the lasting period of the power supplying time.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A fire control device of a toy gun for percussing a firing module, comprising:

a trigger switching module, having a trigger for being pressed to produce a percussion signal;

a firing mode selecting module, provided for selecting firing modes and producing a firing mode signal corresponding to the selected firing mode;

a control module, connected to the trigger switching module and the firing mode selecting module, for receiving the percussion signal and the firing mode signal, so as to produce an enable signal according to the percussion signal and alter a holding time of the enable signal according to the firing mode signal;

a power module, connected with the control module, for supplying power to the control module and also for supplying a motor driving power as the enable signal is produced; and a motor module, connected with the control module, for being driven by the motor driving power to produce a turning power so as to drive a transmission gear set to rotate, thereby compressing a piston to percuss the firing module.

2. The fire control device as claimed in claim 1, further comprising a digital adjustment module for fine tuning the holding time of the enable signal.

3. The fire control device as claimed in claim 1, further comprising a step-down power-saving module, connected with the control module, for driving the control module into a power-saving mode when the control module has not received the percussion signal and the firing mode signal after a particular period of time.

4. The fire control device as claimed in claim 3, wherein the control module switches into the power saving mode until being waked up by the execution of pressing the trigger and/or the selecting execution of the firing mode selecting module.

5. The fire control device as claimed in claim 1, wherein the firing mode selecting module includes a base and a selecting shalt pivoted on the base, wherein the base has at least two contact points, the selecting shaft has a conductive portion for contacting with the base, and when the selecting shaft is moved to rotate on the base, the conductive portion passes the at least two contact points of the base in turn, so that by locating the conductive portion at different contact points, different firing modes are selected.

6. The fire control device as claimed in claim 5, wherein when the selecting shaft stays at one of the at least two contact points which corresponds to a weapon safety mode, the selecting shaft pushes a linking rod, which is capable of automatic reciprocation, then the linking rod moves to turn an engaging knob, and then the engaging knob locks the trigger.

7. The fire control device as claimed in claim 6, wherein the transmission gear set has an anti-reverse structure for engaging with an anti-reverse claw, which is capable of automatic reciprocation, so as to block the reversion of the transmission gear set, and the selecting shaft also pushes a turning shaft to turn, so as to push the anti-reverse claw to disengage with the anti-reverse structure.

8. The fire control device as claimed in claim 5, wherein the base has four contact points mounted thereon which are respectively corresponding to four firing modes, single fire, 3-round burst, continuous fire and weapon safety, and through changing the holding time of the enable signal, the variation of the firing mode is achieved.

9. A fire control method of a toy gun for percussing a firing module, comprising steps of:

selecting a firing mode and providing a firing mode signal corresponding thereto by a firing mode selecting module;

providing a percussion signal by pressing a trigger on a trigger switching module;

producing an enable signal by a control module after receiving the percussion signal and altering a holding time of the enable signal by the control module according to the received firing mode signal;

providing a motor driving power by a power module, connected with the control module, as the enable signal occurs; and producing a turning power by a motor module as being driven by the motor driving power, so as to drive a transmission gear set to rotate, thereby compressing a piston to percuss the firing module.

10. The method as claimed in claim 9, wherein a digital adjustment module is further included for fine tuning the holding time of the enable signal.

11. The method as claimed in claim 9, wherein a step-down power-saving module connected with the control module is further included for driving the control module into a power-saving mode when the control module has not received the percussion signal and the firing mode signal after a particular period of time.

12. The method as claimed in claim 9, wherein the firing mode selecting module includes a base and a selecting shaft pivoted on the base, wherein the base has at least two contact points, the selecting shaft has a conductive portion for contacting with the base, and when the selecting shaft is moved to rotate on the base, the conductive portion passes the at least two contact points of the base in turn, so that by locating the conductive portion at different contact points, different firing modes are selected.

13. The method as claimed in claim 12, wherein when the selecting shaft stays at one of the at least two contact points which corresponds to a weapon safety mode, the selecting shaft pushes a linking rod, which is capable of automatic reciprocation, then the linking rod moves to turn an engaging knob, and then the engaging knob locks the trigger.

14. The method as claimed in claim 13, wherein the transmission gear set has an anti-reverse structure for engaging with an anti-reverse claw, which is capable of automatic reciprocation, so as to block the reversion of the transmission gear set, and the selecting shaft pushes a turning shaft to turn, so as to push the anti-reverse claw to disengage with the anti-reverse structure.

15. The method as claimed in claim 12, wherein the base has four contact points mounted thereon which are respectively corresponding to four firing modes, "single fire, "3-round burst", "continuous fire" and "weapon safety", and through changing the holding time of the enable signal, the variation of the firing mode is achieved.

16. The method as claimed in claim 9, wherein when the time for the firing module to execute a shot at the first time is A and the time to perform a sequential shot is B, for executing the single fire, the holding time of the enable signal is restricted in a range between A and A+B.

17. The method as claimed in claim 16, wherein when the holding time of the enable signal is restricted in a range between A+2B and A+3B, the 3-round burst is executed.

18. The method as claimed in claim 9, wherein when the holding time of the enable signal is controlled to be equal to the time for pressing the trigger, the continuous fire is performed.

* * * * *